310-800

10/13/81 XR 4,295,010 SR

United States Patent [19]

Murphy

[11] 4,295,010

[45] Oct. 13, 1981

[54] PLURAL PIEZOELECTRIC POLYMER FILM ACOUSTIC TRANSDUCER

[75] Inventor: Preston V. Murphy, Geneva, Switzerland

[73] Assignee: Lectret S.A., Geneva, Switzerland

[21] Appl. No.: 123,719

[22] Filed: Feb. 22, 1980

[51] Int. Cl.[3] ..... H04R 17/00

[52] U.S. Cl. ..... 179/110 A; 310/331; 310/800

[58] Field of Search ..... 179/110 A; 310/331, 310/332, 367, 800

[56] References Cited

U.S. PATENT DOCUMENTS 3,792,204 2/1974 Murayama et al. ..... 179/110 A 3,832,580 8/1974 Yamamuro et al. ..... 179/110 A

OTHER PUBLICATIONS

Design of Piezoelectric Audio Transducers, Tamura et al., presented at the joint meeting of the Acoustical Society of America and the Acoustical Society of Japan (Honolulu, 1978.11).

*Primary Examiner*—George G. Stellar

[57] ABSTRACT

An acoustic transducer with a plurality of metal-coated piezoelectric polymer films as an oscillator, adjacent film pairs being physically connected near their centers.

15 Claims, 8 Drawing Figures

FIG 1
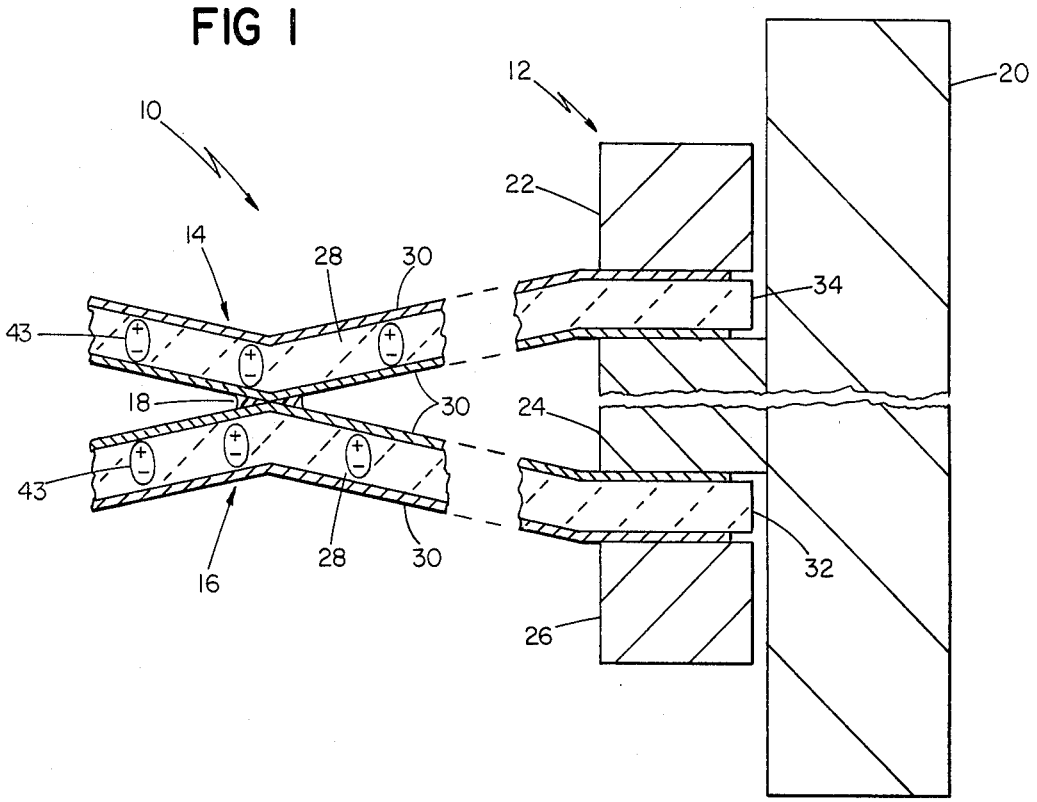
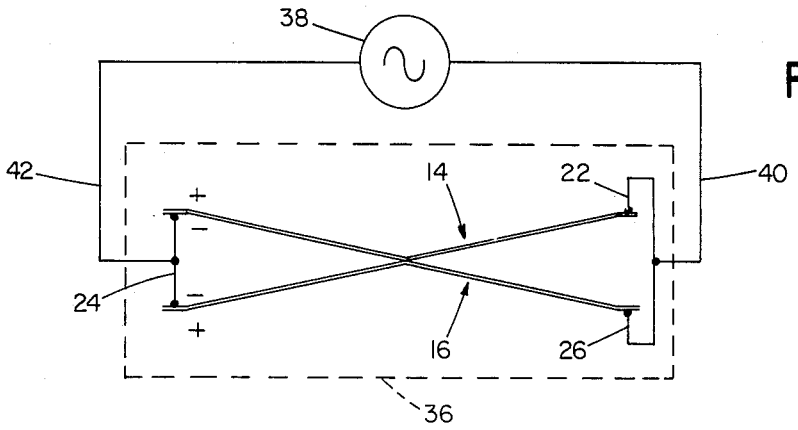
FIG 2
FIG 7
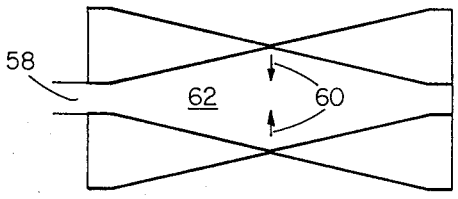
FIG 8
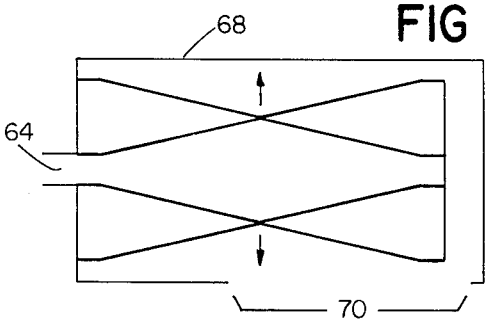

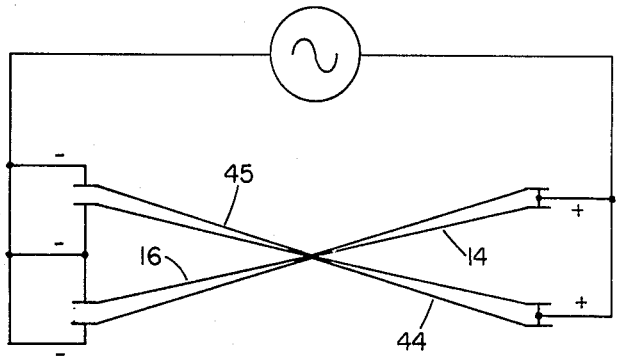
FIG 3
FIG 4
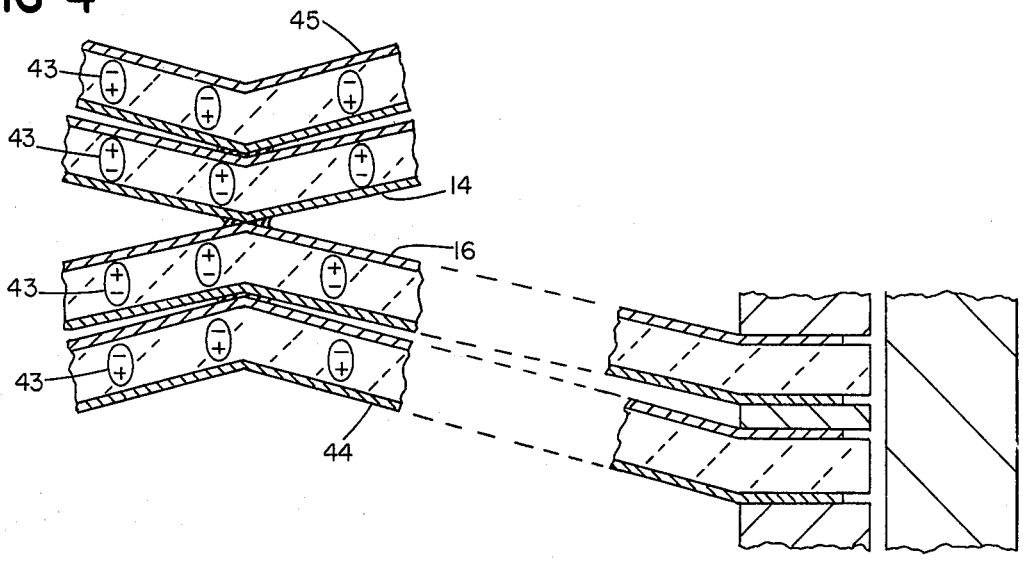
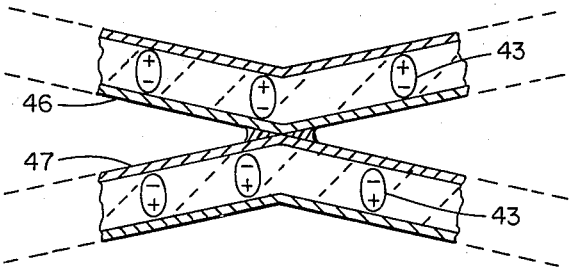
FIG 5
FIG 6
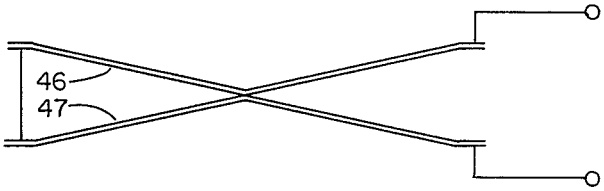

PLURAL PIEZOELECTRIC POLYMER FILM ACOUSTIC TRANSDUCER

FIELD OF THE INVENTION

This invention relates to acoustic transducers employing piezoelectric polymer films.

BACKGROUND OF THE INVENTION

Acoustic transducers using piezoelectric elements as an oscillator are known in the art. For example, U.S. Pat. Nos. 3,832,580 and 3,792,204 disclose transducers employing a single piezoelectric film, an article by Tamura et al. presented in 1978 at the Acoustical Society Meeting in Honolulu discloses a pair of piezoelectric films bonded to the top and bottom surfaces of a polyurethane foam pillow, and U.S. Pat. No. 3,832,580 discloses the use of a plurality of piezoelectric elements suspended in varying configurations. For a given electrical voltage, piezoelectric film transducers typically produce a lower sound amplitude than is produced, for the same voltage, by other types of transducers such as electro dynamic ones. This lower voltage sensitivity can lead to undesirably low sound amplitude in certain applications, such as telephone receivers, wherein the available voltage is low. Furthermore, piezoelectric film transducers used as microphones or transmitters typically produce, for a given sound pressure, a lower output voltage than other types of transducers such as electret condensers. Such lower output can require excessive amplifier gain and result in poor signal-to-noise ratio.

SUMMARY OF THE INVENTION

I have discovered that increased sound amplitude can be provided for a given electrical voltage (or increased voltage for a given sound, in a microphone) by providing a plurality of piezoelectric films that are mounted and spaced apart at their peripheries, physically connected near their centers, and electrically connected in parallel. The resulting transducer is compact, simple, and inexpensive to manufacture. In preferred embodiments the films are connected together at their centers by a dot of epoxy adhesive; the films are cone-shaped with half cone angles greater than 1.20 radians (preferably greater than 1.50 radians); each film is an inner layer of piezoelectric material (e.g., polarized polyvinylidene fluoride) coated with gold; the overall thickness of each film is from 5 to 30 microns; the natural resonant frequency of the transducer is set within the frequency range of voice communication (e.g., below 6000 Hz and preferably from 2000 to 5000 Hz); and the films are mounted at their peripheries in a cylindrical member (e.g., with an interior diameter of from 30 to 60 mm).

DESCRIPTION OF PREFERRED EMBODIMENTS

I turn now to the description of the structure and operation of the presently preferred embodiment after first briefly describing the drawings.

DRAWINGS

FIG. 1 is a diagrammatic vertical sectional view, partially broken away, taken through the center of portions of an acoustic transducer according to the invention.

FIG. 2 is an electrical schematic for said transducer.

FIG. 3 is an electrical schematic for the presently preferred embodiment in which there are four piezoelectric layers.

FIG. 4 is a diagrammatic vertical sectional view of the presently preferred four-layer transducer.

FIG. 5 is a diagrammatic vertical sectional view of a two-layer transducer used as a microphone.

FIG. 6 is an electrical schematic for the microphone of FIG. 5.

FIGS. 7 and 8 are diagrammatic vertical sectional views of two other preferred embodiments in each of which there are two modules each having two piezoelectric layers.

STRUCTURE

In FIG. 1 there are shown center portion 10 and side portion 12 of a headphone transducer. Flat, cone-shaped films 14 and 16 are shown attached at their centers by a dot of epoxy adhesive 18 and mounted at their peripheries to cylindrical wall 20 between rings 22 and 24, and 24 and 26, respectively. Films 14, 16 are constructed of inner layers 28 ( made of polarized polyvinylidene fluoride 9 microns thick), which are coated on all surfaces by 200 A° layers 30 of gold, the coatings ending at a short distance from the film edges. The films are poled to yield high piezoelectric strain coefficients in both directions (x and y) of the film surface (commonly denoted d31 and d32), so that the films deform symmetrically with resulting improved efficiency. The polarization vectors 43 of films 14 and 16 are aligned normal to the film surfaces, and the films are mounted so that both vectors point in the same direction. The films are 5 centimeters in diameter, and their ends 32, 34 are supported 0.5 millimeters apart. The half cone angle of each film is about 1.55 radians. This diaphragm system has a natural resonance of approximately 3000 Hz.

Referring to FIG. 2, the above headphone transducer is generally indicated at 36 and is powered by AC source 38. Line 40 is connected to the upper surface of film 14 and the lower surface of film 16 via rings 22, 26, respectively, and line 42 is connected to the lower surface of film 14 and the upper surface of film 16 via ring 24.

With these connections, the polarity of the voltage applied to film 14 is opposite that applied to film 16, i.e., the charges on the surfaces of films 14, 16 (going from the upper surface of film 14 to the lower surface of film 16) will alternate between $+--+$ and $-++-$. The opposite voltage polarity applied to similarly poled films allows one film to contract while the other expands so that both films move in the same direction.

In FIG. 3 there is shown the electrical schematic for the presently preferred embodiment consisting of four piezoelectric film layers (upper layers 14, 45 and lower layers 16, 44) which are connected electrically so that all move in unison. In FIG. 4 there is shown diagrammatically the direction of polarization and the mechanical assembly of the films from FIG. 3. In FIG. 5 there is shown the center section of a transducer used as a microphone. The construction is identical to FIG. 1 except for the polarization vectors which point in opposite directions for each of films 46, 47. On vibration, the voltages generated by the two films add in series. In FIG. 6 the series electrical connection of films 46, 47 is shown. For a given sound pressure level the output voltage from the two-film microphone is nearly double that of the single-film microphone.

In FIGS. 7 and 8, there are diagrammatically shown two other embodiments in each of which there are two modules each with two piezoelectric films. Each module has the structure shown in FIGS. 1 and 2, and all four films are connected in parallel. In FIG. 7, the acoustic output is directed radially from opening 58, rather than axially as in FIGS. 1 and 2. And as suggested by oppositely directed arrows 60, the two modules work in opposite directions so as to alternately compress and expand volume 62, between them. Similarly in FIG. 8, the two modules work in opposite directions, opening 64 is provided into volume 66 between the modules, and enclosure 68 with off axis opening 70 is provided so as to produce in-phase addition of the pressures generated by the two modules. More than two modules could also be combined following the teaching of FIGS. 7 and 8.

OPERATION

The operation of headphones is well known. By employing a pair (or preferably two pair) of piezoelectric films all electrically-connected in parallel, the driving force of the films against the surrounding air, and hence the sound generated is increased, for the same applied voltage. Such a structure thus provides more decibles per volt than a one-layer structure. For the four film structure of FIG. 3, an improvement of more than 5 decibles is achieved over a single film structure.

Physically connecting the films at their centers permits very thin films (e.g., 5 to 30 microns) to be given a very flat conical shape (i.e., half cone angles greater than 1.20 radians and preferably greater than 1.50 radians) and low tension. Providing thin films, flat conical shapes, and low tension is important because it reduces film stiffness and, in turn, increases the film deflection (and thus the sound) generated for the same applied voltage. Arranging the films in pairs of oppositely-oriented flat cones attached at their centers has the further advantage of limiting the maximum sound volume which can be generated, as neither cone can ordinarily be driven beyond a perfectly flat shape, thereby limiting film deflection in both directions.

In the operation of piezoelectric film microphones, it is known that the highest output is obtained with the least curvature in the diaphragm (a flat diaphragm not being used because it doubles the frequency). Connecting two films at their centers provides excellent means for maintaining small diaphragm curvature for very thin films with low tension (similar to the headphone). Connection of the two films in series augments the voltage output.

OTHER EMBODIMENTS

Other embodiments are within the scope of the invention and claims. For example, the films need not be circular, but could be for instance square or rectangular, the transducer could be used in a microphone, and the natural resonance could be increased to a high frequency for more precise sound reproduction (e.g., of music). Further, more than two modules (of two, four or more films each) could be used.

OTHER INVENTIONS

The subject matter relating to combining modules as shown in FIGS. 7 and 8 was the invention of Reinhart Lerch, and his invention was subsequent to mine.

What is claimed is:

1. An acoustic transducer comprising:
a hollow support member, and
a plurality of metal-coated piezoelectric polymer films to act as an oscillator, said films being
spaced apart at their peripheries,
mounted at said peripheries to said support member, and
physically connected to at least one adjacent film near their centers.

2. The transducer of claim 1 wherein said transducer is for generating sound and said films are electrically connected in parallel and with polarities selected to cause said films to move in the same direction under electrical excitation.

3. The transducer of claim 1 wherein said transducer is for converting sound into an electrical signal and said films are electrically connected in series and with polarities selected to cause the voltage outputs of each of said films to add when said films oscillate.

4. The transducer of claim 1, 2 or 3 in which said films are physically connected together near their centers by a dot of epoxy adhesive.

5. The transducer of claim 1 in which two of said films are flat cone-shaped, one cone is inverted with respect to the other, and said two films are physically connected at the apex of the cones.

6. The transducer of claim 4 in which each said piezoelectric film comprises an inner layer of polarized polyvinylidene fluoride coated on both surfaces with gold.

7. The transducer of claim 1 wherein said films are even in number and adjacent films are physically connected near their centers.

8. The transducer of claim 7 wherein said films are four in number and each of the four films are physically connected near their centers.

9. The transducer of claim 8 wherein said films are flat cone-shaped.

10. The transducer of claim 5 or 9 wherein the half cone angle of each said cone is greater than 1.20 radians.

11. The transducer of claim 10 wherein the half cone angle of each said cone is greater than 1.50 radians.

12. The transducer of claim 1, 5, or 9 wherein the overall thickness of each said film is from 5 to 30 microns.

13. The transducer of claim 1, 5, or 9 wherein the natural resonant frequency of said transducer is set at below 6000 Hz.

14. The transducer of claim 13 wherein the natural resonant frequency of said transducer is set at from 2000 to 5000 Hz.

15. The transducer of claim 1, 5, or 9 wherein said hollow member has a cylindrical interior to which said film peripheries are mounted and said cylindrical interior has a diameter of from 30 to 60 mm.

* * * * *